US007078626B2

(12) United States Patent
Somers et al.

(10) Patent No.: US 7,078,626 B2
(45) Date of Patent: Jul. 18, 2006

(54) CABLE APPARATUS FOR MINIMIZING SKEW DELAY OF ANALOG SIGNALS AND CROSS-TALK FROM DIGITAL SIGNALS AND METHOD OF MAKING SAME

(75) Inventors: Steve L. Somers, Chino Hills, CA (US); Ash Raheja, Foothill Ranch, CA (US); Jacob Geil, Irvine, CA (US)

(73) Assignee: RGB Systems, Inc., Anaheim, CA (US)

( * ) Notice: Subject to any disclaimer, the term of this patent is extended or adjusted under 35 U.S.C. 154(b) by 0 days.

(21) Appl. No.: 10/800,275

(22) Filed: Mar. 12, 2004

(65) Prior Publication Data

US 2005/0199416 A1 Sep. 15, 2005

(51) Int. Cl.
*H01B 7/00* (2006.01)

(52) U.S. Cl. ..... 174/113 R

(58) Field of Classification Search ..... 174/27, 174/33, 34, 36, 110 R, 113 R
See application file for complete search history.

(56) References Cited

U.S. PATENT DOCUMENTS 3,297,814 A * 1/1967 McClean et al. ..... 174/41
3,546,357 A * 12/1970 Windeler et al. ..... 174/34
4,381,426 A * 4/1983 Cronkite et al. ..... 174/117 F
4,467,138 A * 8/1984 Brorein ..... 174/115
4,486,619 A * 12/1984 Trine et al. ..... 174/34
4,533,790 A * 8/1985 Johnston et al. ..... 174/115
4,697,051 A * 9/1987 Beggs et al. ..... 178/63 D
4,767,891 A * 8/1988 Biegon et al. ..... 174/34
5,162,609 A * 11/1992 Adriaenssens et al. ..... 174/34
5,180,890 A * 1/1993 Pendergrass et al. .... 174/117 F
5,298,680 A * 3/1994 Kenny ..... 174/36
5,493,071 A * 2/1996 Newmoyer ..... 174/113 R
5,514,837 A * 5/1996 Kenny et al. ..... 174/113 R
5,601,447 A * 2/1997 Reed et al. ..... 439/404
5,659,152 A * 8/1997 Horie et al. ..... 174/113 R
5,744,757 A * 4/1998 Kenny et al. ..... 174/113 R
5,767,441 A * 6/1998 Brorein et al. ..... 174/27
5,814,406 A * 9/1998 Newmoyer ..... 428/379
5,814,768 A * 9/1998 Wessels et al. ..... 174/110 FC
5,834,697 A * 11/1998 Baker et al. ..... 174/113 R
5,932,847 A * 8/1999 Mayfield ..... 174/113 R
6,147,309 A * 11/2000 Mottine et al. ..... 174/110 PM
6,153,826 A * 11/2000 Kenny et al. ..... 174/27
6,194,663 B1 * 2/2001 Friesen et al. ..... 174/110 R
6,323,427 B1 * 11/2001 Rutledge ..... 174/113 R
6,348,651 B1 * 2/2002 Chou et al. ..... 174/27
6,355,876 B1 * 3/2002 Morimoto ..... 174/27
6,452,094 B1 * 9/2002 Donner et al. ..... 174/27

(Continued)

*Primary Examiner*—William H. Mayo, III
(74) *Attorney, Agent, or Firm*—The Hecker Law Group, PLC

(57) ABSTRACT

An unshielded twisted pair (UTP) cable having a common electrical length among a plurality of twisted pairs for carrying analog signals and a different lay length and lay direction to an additional twisted pair for carrying digital signals is disclosed. The twisted pairs for carrying the analog signals may be bundled together, with the twisted pair for carrying the digital signal placed alongside the bundled pairs during the final jacketing process, during which the outer insulator is formed around all of the pairs. The bundled pairs may be used for the transmission of analog video signals (e.g., R, G and B), with the remaining pair used for transmission of digital control or digital audio signals.

20 Claims, 5 Drawing Sheets

U.S. PATENT DOCUMENTS 6,687,437 B1 * 2/2004 Starnes et al. ..... 385/101
6,770,819 B1 * 8/2004 Patel ..... 174/113 R
6,787,694 B1 * 9/2004 Vexler et al. ..... 174/27
6,818,832 B1 * 11/2004 Hopkinson et al. ..... 174/113 R
6,825,410 B1 * 11/2004 Chou ..... 174/27

* cited by examiner

CABLE APPARATUS FOR MINIMIZING SKEW DELAY OF ANALOG SIGNALS AND CROSS-TALK FROM DIGITAL SIGNALS AND METHOD OF MAKING SAME

BACKGROUND OF THE INVENTION

1. Field of the Invention

This invention relates to the field of electronic cable equipment, and more specifically, to cables used for the concurrent transmission of analog and digital signals, such as for analog video and digital audio.

2. Background Art

Data networks, or LANs, typically use low cost UTP (unshielded twisted pair) wire for bi-directional communication of digital data. In addition, special application of UTP may be used to convey analog video signals over a dedicated video-type network. In both cases, the current constructions of UTP wherein four twisted pairs are utilized, involve manipulation of the twisted pairs such that each pair has a different lay length throughout the cable so as to minimize cross-talk of data signals between pairs. Various lay lengths are combined such that coupling is minimized. One configuration describes a UTP cable having two of the typically four pairs twisted in a right-hand direction while the remaining two pairs are twisted in the usual left-hand direction. This combination further minimizes cross coupling for data signals traveling on the cable pairs.

FIGS. 1A and 1B illustrate the construction of a prior art Unshielded Twisted Pair (UTP) cable for data transmission. As illustrated in FIG. 1A, a typical UTP cable 100 comprises four twisted pair wires 104, 106, 108, and 110, all located within a cable bundle. The bundled twisted pair wires are held together with insulation layer 102. Referring to FIG. 1B, each of the four twisted pairs (e.g. 104, 106, 108 or 110) consists of two wires identified with suffix "A" and "B" and having a specific lay length. For instance, twisted pair 104 comprises wire 104A and wire 104B having a constant lay length "A" throughout its length; twisted pair 106 comprises wire 106A and wire 106B having a constant lay length "B" throughout its length; twisted pair 108 comprises wire 108A and wire 108B having a constant lay length "C" throughout its length; and twisted pair 110 comprises wire 110A and wire 110B having a constant lay length "D" throughout its length.

As illustrated, each of the prior art twisted pair cables (e.g. 104, 106, 108, or 110) has a specific lay length different from the other twisted pairs. All of these twisted pairs, each one made with a specific lay length, are located side-by-side within a cable bundle. The different lay lengths contribute to reduced cross-talk.

In the application of analog video, including RGB analog video or graphics, UTP data cables may be utilized. Implementations suffer from the fact that the data cable construction having different lay lengths between conducting pairs results in each pair having a different electrical length. The differing electrical lengths result in proportional delay of the video signal when applied over the long distances (around 100 meters or more) typically encountered in this type of application.

The different electrical lengths result in a relative delay between RGB signals in an RGB analog video implementation, for example. The delay period is long enough to create an offset of visual information on the display screen so as to appear misconverged. Graphics details will not properly line up on the screen at the appropriate location. This "fringing effect" makes for poor quality or totally unacceptable video performance. To counteract this affect, some form of delay must be added to the shorter pathways in the transmission line to equalize the delays such that the longest delay becomes the standard by which the others are adjusted. Various methodologies for accomplishing this are known. For example, an appropriate length of cable may be added to each of the faster transmission lines to compensate. In addition, various electrical circuit schemes exist for delaying video channels within the processing system that receives the UTP-transmitted information and converts it to usable analog content.

The above scenario describes results based on use of three of the four available twisted pairs within the bundle. The three active pairs are conveying red, green, and blue signals respectively. The fourth pair of the bundle may or may not be used. In cases where the fourth pair is used, it may carry digital control and/or audio channels. The intimacy of this fourth pair with the other three carrying video information can cause significant signal coupling, or cross-talk, wherein the digital signal induces noise into any or all of the three video-carrying pairs.

Extron recognized a need to correct for these problems by manufacturing a low-skew UTP cable. In the low-skew cable, the lay lengths of the twisted pairs are equal in length. Equal lay lengths on the pairs mean that the electrical lengths are very nearly equal. The time difference becomes so small that it is, for all practical purposes, negligible. Furthermore, the twisted pairs are bundled together utilizing the standard twist-lay process used for such a cable. This is a departure for UTP-type data networks because the equal length pairs will promote close coupling of digital data and not be suitable for data networks.

In analog video and graphics application, the cross coupling is not a prime issue. The cross coupling is small enough that the receiver can be equalized to mostly ignore it since the analog video system is a one-way transmission application. However, when digital control signals and/or digital audio channels are conveyed over the fourth pair in these applications, noise is often induced into one or more of the video-carrying pairs. Additionally, the signaling voltage on the typical analog RGB or video system is not compliant with voltages used for data networks. This means that UTP cabling that might be used for data networks must be wholly dedicated to the analog video application and cannot be shared. Applying the typical analog video connection to a UTP within a data network will not only be format incompatible, it will likely damage network components.

Utilization of the low-skew UTP cable is appropriate for dedicated installations where prior knowledge of the analog video/graphics system is prescribed. Clearly, this cable will be dedicated to the analog "network" and not used for data. Likewise, the data network could use the cable but will likely not use it because key cross-talk parameters important to data network communications will be severely compromised such that the data network node may not perform at all.

Therefore, there is a need for a cable that can satisfy the low skew requirements of video signaling, while providing sufficient cross-talk isolation so that digital information simultaneously conveyed through the cable does not significantly impair the quality of the video signals.

SUMMARY OF THE INVENTION

The present invention provides a cable apparatus for minimizing skew delay of analog signals and cross-talk from digital signals, and method of making same. In an embodiment of the invention, the cable comprises multiple unshielded twisted pairs (UTP) of conductors that accommodate the transmission of multiple analog signals, such as for analog video, and one or more digital signals, such as for digital control and/or audio. The twisted pairs used to transmit analog signals may be of substantially uniform electrical length to minimize skew, and may also be twisted in the same lay direction (i.e., clock-wise or counter-clockwise).

To minimize cross-talk between the pair(s) carrying digital signal(s) and the pairs carrying analog signals, the twisted pair or pairs used to transmit digital signals may be twisted in the opposite lay direction with respect to the analog pairs, and may have a lay length that differs from any lay length used in the twisting of the analog pairs. In embodiments providing multiple pairs for digital transmission, the lay lengths and the lay directions of those pairs may also differ from one another.

In one embodiment, the twisted pairs for transmitting analog signals may be bound together as a group, and the pair or pairs for transmitting digital signals may be laid alongside the bundled pairs when the outer insulator jacket is applied to the cable. A UTP cable having the typical four twisted pair couplets may be constructed wherein three of the pairs may be constructed with the same lay length and lay direction, while the fourth pair may be constructed with a different lay length and opposite lay direction.

DETAILED DESCRIPTION

A cable apparatus for minimizing skew delay of analog signals and cross-talk from digital signals, and method of making same are described. In the following description, numerous specific details are set forth to provide a more thorough description of the present invention. It will be apparent, however, to one skilled in the art, that the present invention may be practiced without these specific details. In other instances, well known features have not been described in detail so as not to obscure the present invention.

Embodiments of the invention may be constructed in a manner that provides for a group of twisted pairs having the group characteristic of low skew, while one or more further twisted pairs have the characteristic of reduced cross-talk with respect to the first group of twisted pairs and each other. For purposes of example, an embodiment suited to analog video applications will be described. Specifically, in this embodiment, a group of three twisted pairs of conductors is constructed with minimal skew for the purposes of transmitting three analog color video channels, e.g., a red (R) channel, a green (G) channel and a blue (B) channel. A fourth twisted pair of conductors is constructed to provide reduced cross-talk. This fourth pair may be used in the video application for the transmission of a digital (or analog) audio signal or a digital control signal, for example.

The structural features and method of construction associated with this four-pair embodiment may be similarly applied in other embodiments having more or fewer pairs with minimal skew, as well as more pairs with minimized cross-talk.

Figure 1A:
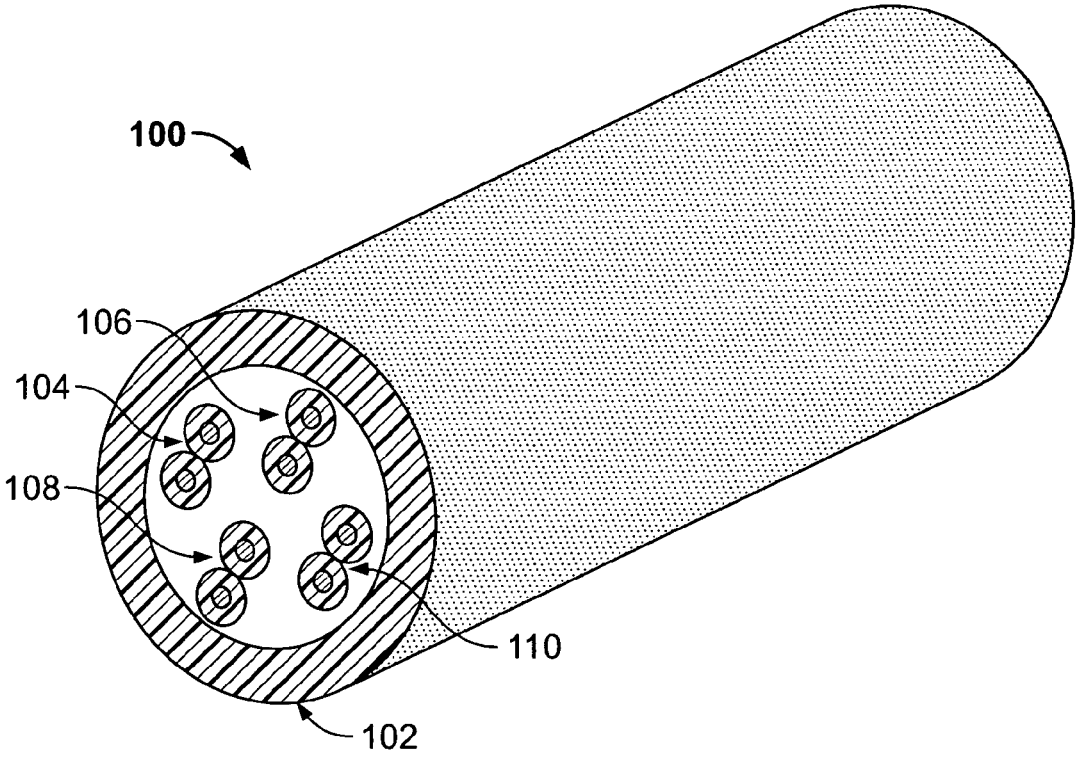
FIG. 1A (Prior Art)
FIGS. 1A and 1B show a typical example of a UTP cable of the prior art.
Figure 1B:
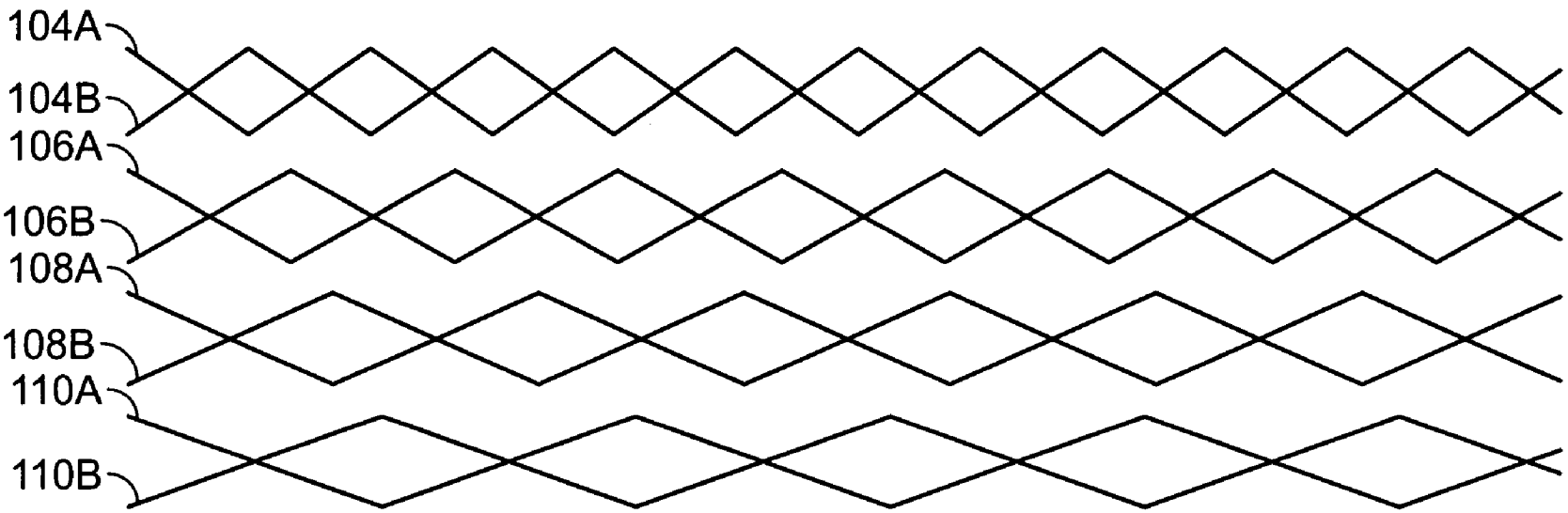
FIG. 1B (Prior Art)
Figure 2:
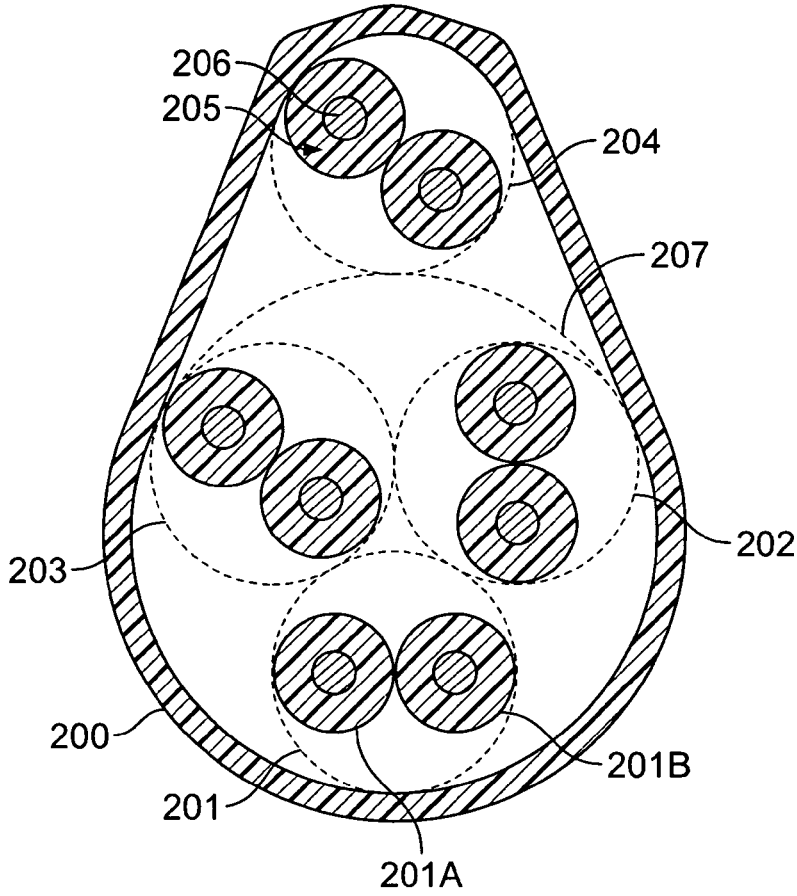
FIG. 2 is a cross-sectional view of a UTP cable in accordance with an embodiment of the invention.

FIG. 2 is a cross-sectional view of a UTP cable in accordance with an embodiment of the invention. The UTP cable comprises twisted pairs 201–204 surrounded by an outer protective jacket or sleeve 200. Each twisted pair contains a pair of wires (e.g., 201A and 201B), each of which comprises an inner conductor core 206 in an insulating sleeve 205.

Inner conductor 206 may be formed of, for example, of copper or some other conducting material. Insulation 205 may be formed of, for example, polyolefin or some other flexible material with insulating properties. The insulation 205 may be color coded or otherwise marked to identify respective pairs and individual wires within each pair. The outer jacket may be formed of, for example, extruded PVC (polyvinyl chloride) material.

In FIG. 2, the dashed circles around each twisted pair represent the cross-sectional area occupied within the cable by the twisting of each pair. Dashed circle 207 represents the bundled pairs 201–203, occupying a circular cross-sectional area within the cable due to the twist bundling of pairs 201, 202 and 203. Twisted pair 204 occupies a cross-sectional area of the cable outside of the perimeter associated with bundle 207, giving the overall cable cross-section a "tear drop" shape.

Figure 3:
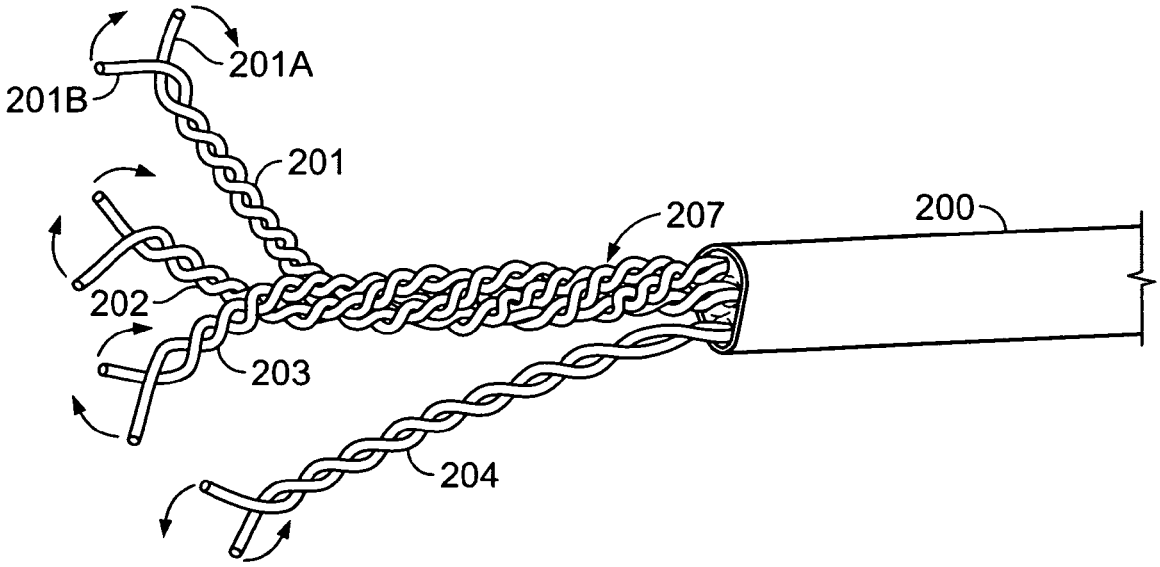
FIG. 3 is a cut-away view of a UTP cable in accordance with an embodiment of the invention.

FIG. 3 is a cut-away view of a UTP cable constructed in accordance with an embodiment of the invention. In FIG. 3, the different lay (or twist) directions within the UTP cable are made apparent. In the illustrated embodiment, twisted pairs 201, 202 and 203 are individually twisted in a first lay direction (i.e., clockwise). Twisted pairs 201–203 are then twisted together as a bundle (207), similarly in the first lay direction (clockwise).

Twisted pair 204 is not twisted within bundle 207, but is rather laid in parallel with bundle 207. Further, twisted pair 204 is twisted in the opposite lay direction (i.e., counter-clockwise). While FIG. 3 is not drawn to scale, the lay length of twisted pair 204 can be seen to be longer (i.e., has a lower twist rate) than the common lay length of twisted pairs 201–203. The differences in lay length are more clearly illustrated in FIGS. 4A and 4B.

Figure 4A:
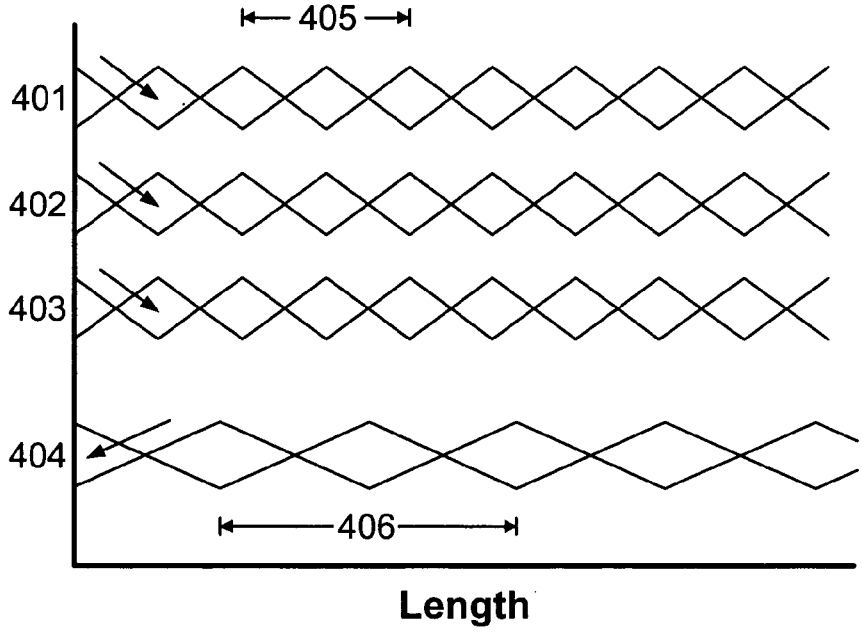
FIGS. 4A and 4B are flattened views of a four-pair UTP cable in accordance with embodiments of the invention.

FIG. 4A is a flattened representation of the twisted pairs in accordance with one embodiment of the invention. In this embodiment, twisted pairs 401, 402 and 403 have the same lay length 405 and the same lay direction (represented by the arrows pointing to the right). Although twisted pairs 401, 402 and 403 are shown here with the same twisting phase (i.e., the twist "peaks" line up with each other), such an alignment is not required.

Twisted pair 404 is illustrated at some distance away from twisted pairs 401–403 to represent the fact that twisted pair 404 is not intimately bundled within the group including twisted pairs 401–403. Twisted pair 404 is illustrated with lay length 406 that is noticeably longer (i.e., has a lower twist rate) than that of twisted pairs 401–403 (i.e., lay length 405). Also, the lay direction (represented by the arrow pointing to the left) of twisted pair 404 is preferably opposite to that of twisted pairs 401–403.

Figure 4B:
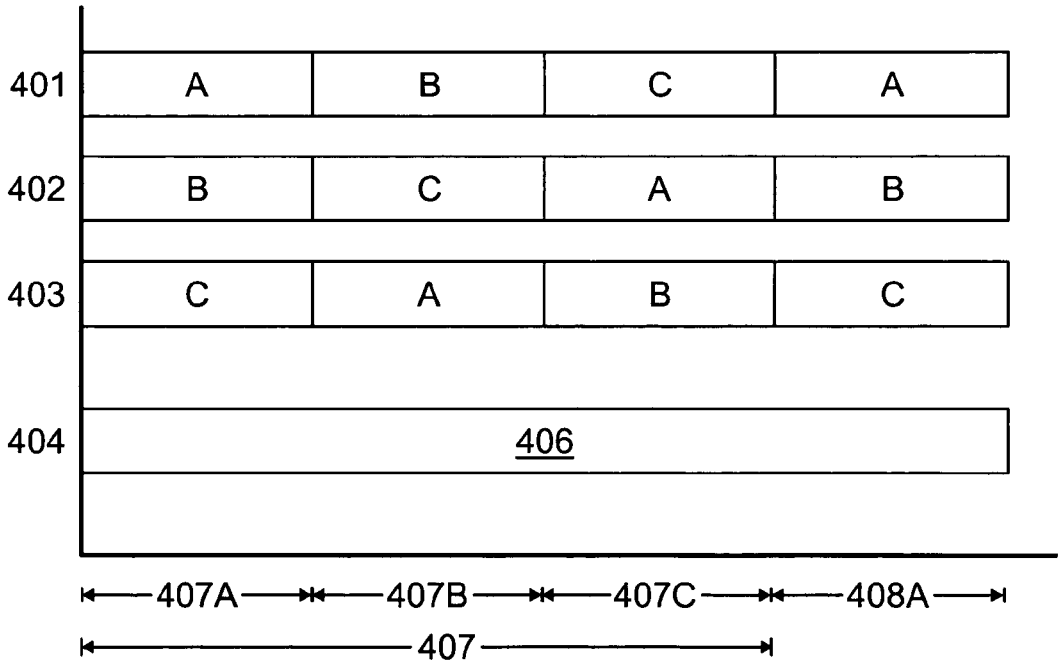

FIG. 4B illustrates an application of twist rates in accordance with an embodiment of the invention, in which twisted pairs 401–403 use multiple lay lengths, while maintaining substantially equivalent electrical lengths. As shown, during subinterval 407A, twisted pair 401 has lay length A, twisted pair 402 has lay length B, and twisted pair 403 has lay length C. During subinterval 407B, twisted pair 401 has lay length B, twisted pair 402 has lay length C, and twisted pair 403 has lay length A. During subinterval 407C, twisted pair 401 has lay length C, twisted pair 402 has lay length A, and twisted pair 403 has lay length B. Subinterval 408A repeats the lay length assignment of subinterval 407A, and so on. Twisted pair 404 is illustrated with lay length 406 throughout, which is preferably different than any of lay lengths A, B or C. (In embodiments with multiple additional pairs like twisted pair 404, those additional pairs may also implement a staggered or varying lay length arrangement.)

The electrical lengths of twisted pairs 401, 402 and 403 are unequal during any of the single distance subintervals illustrated (e.g., 407A, 407B, etc.) due to the different lay lengths implemented for each pair. However, over the complete distance interval 407, the lay length assignments complete a cycle in which each pair has applied each lay length for an approximately equivalent distance, thus providing equivalent electrical lengths over the complete interval.

The use of staggered lay length assignments in this embodiment improves cross-talk rejection between twisted pairs 401, 402 and 403. Further, by cutting the resulting cable into segments approximately equal to distance interval 407 or integer multiples thereof, the cable segments will have substantially equivalent electrical lengths within the group including pairs 401–403, satisfying the objective of minimized skew.

Figure 5:
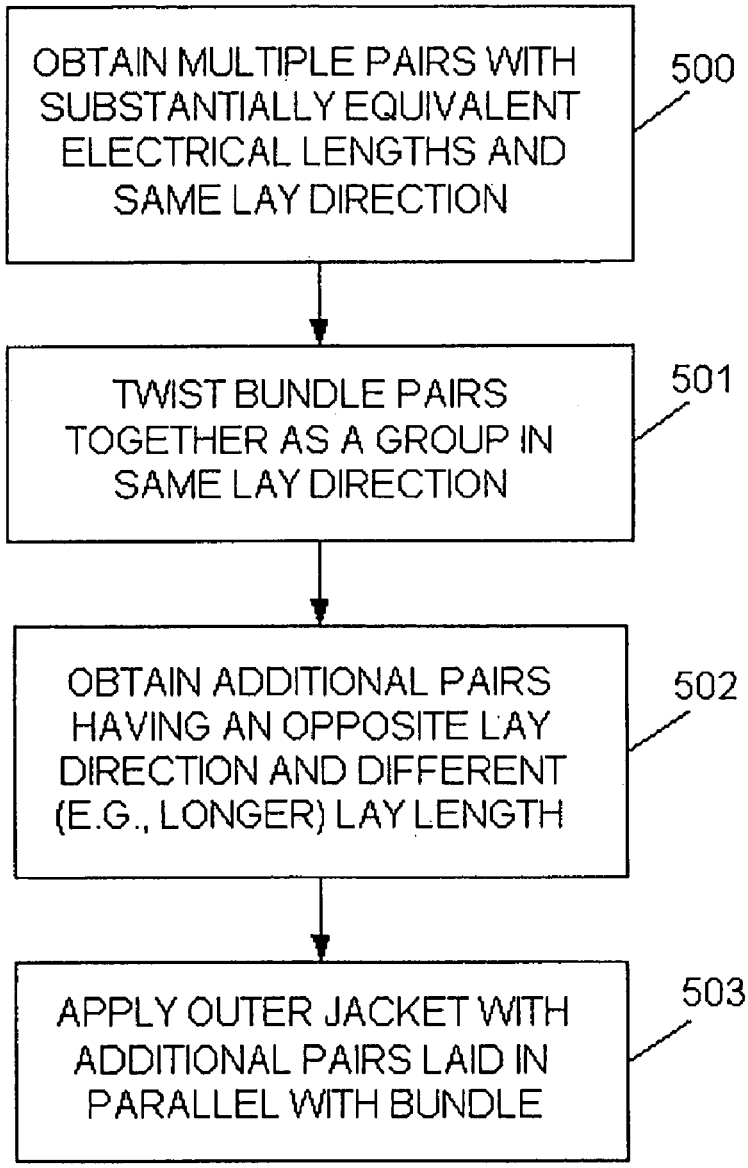
FIG. 5 is a flow diagram of a process for making a UTP cable in accordance with an embodiment of the invention.

FIG. 5 is a flow diagram of a process for constructing a UTP cable, in accordance with one embodiment of the invention. In block 500, a group of twisted-pair conductors are obtained with substantially equivalent electrical lengths. For the purposes of this description, substantial equivalence in electrical length means that the maximum difference in electrical length between any two twisted pairs is within a specified tolerance range. This specified tolerance range may vary for different applications, depending on the level of signal synchronization needed. For example, the tolerance range in a standard color video application might be at or around 0.5 inches in one embodiment.

The twisted pairs in this group may have a uniform lay length, or they may use a staggered arrangement of different lay lengths, as long as the overall electrical length within the group is uniform. This uniformity of electrical length provides the minimized skew characteristic desired in, for example, analog video applications. Preferably, the lay direction is the same for each twisted pair in the group.

In block 501, the twisted pairs may be twist-bundled together as a group, preferably, though not necessarily, with a bundled twist in the same lay direction as the individual pairs. This bundling helps to strengthen the cable, simplify the final jacketing process, and further enhance cross-talk rejection with respect to pairs that are not intimately bundled with the group.

In block 502, one or more additional twisted pairs are obtained that have a different lay length than the individual pairs in the bundled group. Preferably, the lay length(s) of the additional twisted pairs are longer than, and not an integer multiple of, the lay length(s) within the bundled group. For multiple additional pairs, their respective lay lengths may also differ from one another, at least in adjoining sections. For greater cross-talk rejection with respect to the bundled group of pairs, the additional pair(s) may have a lay direction that is opposite to that of the pairs in the bundled group.

In block 503, the outer insulator jacket is applied, with the additional pair(s) fed parallel to the bundled group during jacket extrusion. The result is a UTP cable having a group of pairs with minimal skew between them and significant cross-talk rejection with respect to one or more additional pairs. For a 3-and-1 UTP cable embodiment (i.e., three pairs in the bundle with one additional pair alongside), the resulting cross-section may be somewhat "tear drop" shaped.

In embodiments where the pairs in the bundled group have staggered sections of differing lay lengths, uniformity of the electrical lengths in the group may be optimized at intervals along the cable (e.g., where the staggered lay-length pattern repeats). In some embodiments, those intervals may be marked on the outside of the cable jacket to facilitate cutting lengths of cable that will provide optimum performance.

Thus, a cable apparatus for minimizing skew delay of analog signals and cross-talk from digital signals, and method of making same, have been described. Particular embodiments described herein are illustrative only and should not limit the present invention thereby. The invention is defined by the claims and their full scope of equivalents.

What is claimed is:

1. A cable comprising:

a plurality of first twisted pairs of conductors having a first lay direction and a first lay length, wherein said plurality of first twisted pairs are twisted together in said first lay direction to form a bundle, wherein said plurality comprises at least three; and a second twisted pair of conductors having a second lay direction and a second lay length, wherein said second lay direction is opposite to said first lay direction and wherein said second lay length is different than said first lay length; and an outer jacket encompassing said bundle and said second twisted pair, wherein said second twisted pair is laid in parallel and not twisted together with said bundle.

2. The cable of claim 1, wherein said second lay length is longer than said first lay length.

3. The cable of claim 1, wherein said first lay direction is clockwise and said second lay direction is counterclockwise.

4. The cable of claim 1, wherein said first lay direction is counterclockwise and said second lay direction is clockwise.

5. The cable of claim 1, wherein said bundle is twisted in said first lay direction.

6. The cable of claim 1, wherein said plurality of first twisted pairs are of substantially equivalent electrical length.

7. The cable of claim 6, wherein said outer jacket comprises markings for cutting locations associated with minimum skew.

8. The cable of claim 1, further comprising a third twisted pair laid in parallel with said bundle and encompassed by said outer jacket.

9. The cable of claim 1, wherein said cable has a tear drop shaped cross-section.

10. A UTP cable comprising:

a bundle of twisted pairs, said bundle comprising:

a first twisted pair;

a second twisted pair; and a third twisted pair;

wherein said first twisted pair, said second twisted pair and said third twisted pair have a common lay length and a common lay direction, and are twisted together in said common lay direction to form said bundle;

a fourth twisted pair laid in parallel with and outside a perimeter of said bundle, said fourth twisted pair having a lay length different from said common lay length and a lay direction opposite to said common lay direction.

11. The cable of claim 10, further comprising an outer jacket encompassing said bundle and said fourth twisted pair.

12. The cable of claim 10, wherein said bundle is twisted in said common lay direction.

13. The cable of claim 10, wherein said cable has a tear drop shaped cross-section.

14. A method for making a cable comprising:

twisting together a plurality of twisted pairs into a bundle in a first common lay direction, each of said plurality of twisted pairs having said common lay direction and a common lay length;

laying an additional twisted pair in parallel with said bundle, said additional twisted pair having a second lay direction that is opposite to said common lay direction and a second lay length that differs from said common lay length;

encompassing said bundle and said additional twisted pair in an outer jacket.

15. The method of claim 14, wherein said encompassing comprises feeding said bundle and said additional twisted pair in parallel through an extruder.

16. The method of claim 14, wherein said twisting is performed in said common lay direction.

17. The method of claim 14, wherein said additional twisted pair has a lay length that is longer than said common lay length.

18. The method of claim 14 wherein said plurality is three.

19. The method of claim 14, wherein said common lay direction is clockwise.

20. The method of claim 14, wherein said common lay direction is counterclockwise.

* * * * *